US008050613B2

(12) United States Patent
Domoto et al.

(10) Patent No.: US 8,050,613 B2
(45) Date of Patent: Nov. 1, 2011

(54) WHITE-OUT FOR PAPER REUSE

(75) Inventors: Gerald A. Domoto, Briarcliff Manor, NY (US); Stephan V. Drappel, Mississauga, CA (US); Ruddy Castillo, Briarwood, NY (US)

(73) Assignee: Xerox Corporation, Norwalk, CT (US)

( * ) Notice: Subject to any disclaimer, the term of this patent is extended or adjusted under 35 U.S.C. 154(b) by 460 days.

(21) Appl. No.: 12/338,246

(22) Filed: Dec. 18, 2008

(65) Prior Publication Data

US 2010/0158589 A1 Jun. 24, 2010

(51) Int. Cl.
*G03G 15/20* (2006.01)

(52) U.S. Cl. .... 399/341; 347/155; 347/212; 430/124.13

(58) Field of Classification Search ..... 347/155, 347/212; 400/120.18; 430/124.13–124.2; 399/341, 339
See application file for complete search history.

(56) References Cited

U.S. PATENT DOCUMENTS 5,632,856 A 5/1997 Buie
6,486,903 B1 * 11/2002 Wagner et al. ..... 347/212
6,891,640 B2 5/2005 Kakikawa et al.
7,366,429 B2 4/2008 Nakamoto
2003/0203294 A1 10/2003 Bhattacharya et al.
2004/0005178 A1 * 1/2004 Frohlich ..... 399/341
2004/0080787 A1 * 4/2004 Kakikawa et al. ..... 358/1.18
2007/0132796 A1 6/2007 Jovanovic et al.

OTHER PUBLICATIONS

Sudhakar Madhusoodhanan et al, UV Curable High Opacity Ink Jettable White Ink, Hexion Special Chemicals, RadTech e/5 2006 Technical Proceedings, 2006.
Hexion Specialty Chemicals, "HexiJet UV Curable White Inkjet Ink: Technical Data Sheet"; HCD-2717 (Rev. Oct. 22, 2008), 2008.
www.sunchemical.dev01.10floor.com/press_2003_1_1090856727441.aspx; Sun Chemical Press Release; "SunJet Launches Two UV Inkjet Technologies", Fort Lee, NJ Sep. 29, 2003.

* cited by examiner

*Primary Examiner* — David Gray
*Assistant Examiner* — Ruth Labombard
(74) *Attorney, Agent, or Firm* — Pepper Hamilton LLP

(57) ABSTRACT

A method of reusing a sheet includes receiving a sheet having a printed image, scanning a new image, determining whether the sheet is acceptable for reuse, covering at least one portion of the printed image on the sheet with a white-out toner via a white-out unit, fusing the white-out toner to the at least one portion of the sheet, printing a new image onto the sheet, and performing the receiving, scanning, determining, covering, fusing and printing operations on the sheet a plurality of times. A printing device for covering and printing over a printed image includes a receiving subsystem configured to receive a sheet, a processing module configured to determine whether the sheet is acceptable for reuse, and a fuser module configured to fuse a white-out toner.

20 Claims, 2 Drawing Sheets

WHITE-OUT FOR PAPER REUSE

BACKGROUND

In business environments, companies are increasingly concerned about monitoring and reducing wasteful consumption of resources. Resource consumption within an office environment typically includes energy and paper consumption. For instance, documents containing mistakes or other inaccuracies prior to printing or copying generally result in fresh reprints and a discarding of the erroneous documents. As such, paper consumption and the cost of paper disposal can represent a burdensome expense.

Paper requires ~20 watt-hours of energy per sheet to make. In contrast, toner only requires 2-4 watt-hours of energy per sheet and fusing the toner to the sheet requires 0.2 to 0.5 watt-hours per sheet.

SUMMARY

Before the present systems, devices and methods are described, it is to be understood that this disclosure is not limited to the particular systems, devices and methods described, as these may vary. It is also to be understood that the terminology used in the description is for the purpose of describing the particular versions or embodiments only, and is not intended to limit the scope.

It must also be noted that as used herein and in the appended claims, the singular forms "a," "an," and "the" include plural references unless the context clearly dictates otherwise. Thus, for example, reference to a "device" is a reference to one or more devices and equivalents thereof known to those skilled in the art, and so forth. Unless defined otherwise, all technical and scientific terms used herein have the same meanings as commonly understood by one of ordinary skill in the art. Although any methods, materials, and devices similar or equivalent to those described herein can be used in the practice or testing of embodiments, the preferred methods, materials, and devices are now described. All publications mentioned herein are incorporated by reference. Nothing herein is to be construed as an admission that the embodiments described herein are not entitled to antedate such disclosure by virtue of prior invention. As used herein, the term "comprising" means "including, but not limited to."

In an embodiment, a method of reusing a sheet includes receiving a sheet having a printed image, scanning a new image, determining whether the sheet is acceptable for reuse, covering at least one portion of the printed image on the sheet with a white-out toner via a white-out unit, fusing the white-out toner to the at least one portion of the sheet, printing a new image onto the sheet, and performing the receiving, scanning, determining, covering, fusing and printing operations on the sheet a plurality of times.

In an embodiment, a printing device for covering and printing over a printed image includes a receiving subsystem configured to receive a sheet, a processing module configured to determine whether the sheet is acceptable for reuse, and a fuser module configured to fuse a white-out toner.

BRIEF DESCRIPTION OF THE DRAWINGS

Aspects, features, benefits and advantages of the present application will be apparent with regard to the following description and accompanying drawings, of which.

DETAILED DESCRIPTION

The following terms shall have, for the purposes of this application, the meanings set forth below.

For the purposes of the discussion below, a "printing device" is an electronic device that is capable of receiving commands and printing text and/or images on a substrate and/or scanning a document. Printing devices may include, but are not limited to, network printers, production printers, copiers, facsimile devices, other devices using ink or toner, and scanners. Printing devices may also perform a combination of functions such as printing/scanning/copying/faxing, in which case such devices may be considered to be multi-functional devices.

A "sheet" refers to a document or other substrate used by a printing device. A sheet may refer to a sheet of paper and/or the like.

"Toner" refers to the wet or dry material that forms an image or text on a substrate. The terms ink and toner are used interchangeably to refer to this material.

A "white-out unit" is an electromechanical device that is capable of receiving commands and printing white toner on at least portions of a substrate.

Figure 1:
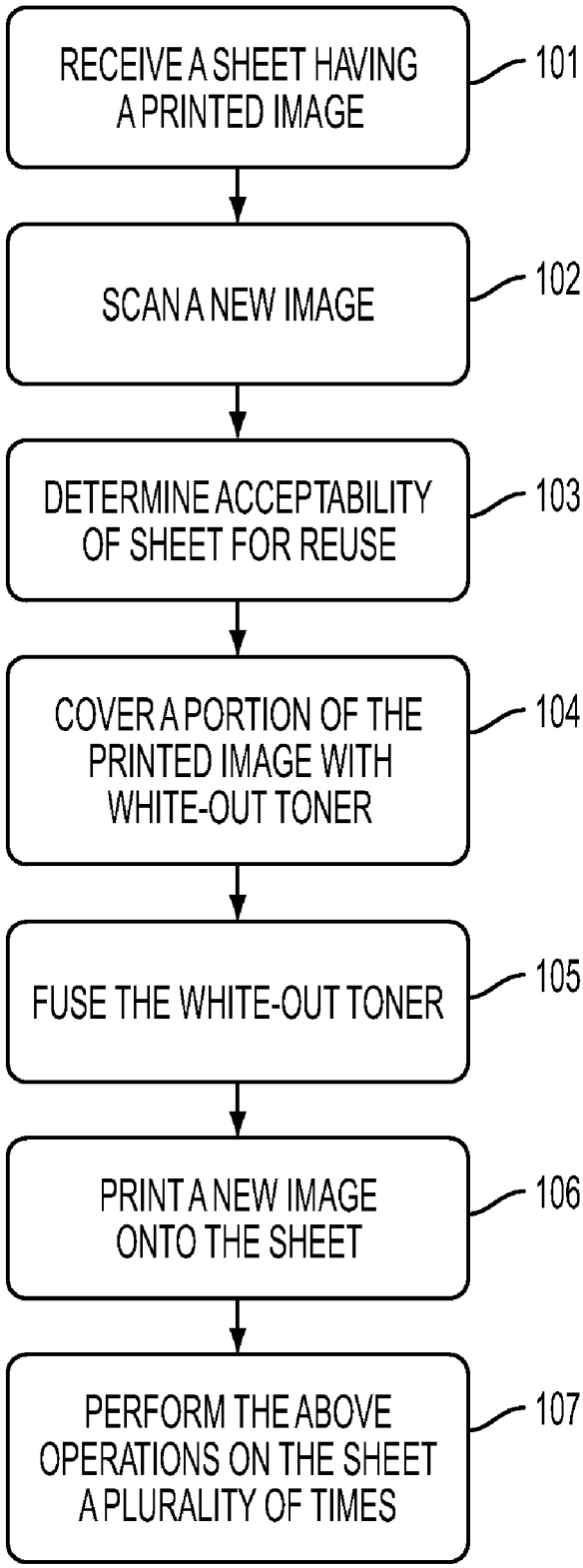
FIG. 1 depicts a flow diagram of exemplary method of reusing a sheet according to an embodiment.

FIG. 1 depicts a flow diagram of a first exemplary method of reusing paper according to an embodiment. As shown in FIG. 1, a sheet having a printed image may be received 101. In an embodiment, the sheet may be received 101 from a user. Alternatively, the sheet may be received 101 from a machine and/or the like. The sheet may be a piece of paper or a similar medium. Additional and/or alternate types of sheets may also be used within the scope of this disclosure.

A new image may be scanned 102. A determination 103 may be made as to whether the sheet is acceptable for reuse. In an embodiment, determining 103 whether the sheet is acceptable for reuse may include determining whether the sheet is ripped, substantially wrinkled, and/or stained. If the sheet is determined to be ripped, substantially wrinkled, and/or stained, the sheet may be determined to be unacceptable for reuse and at least one portion of the printed image on the sheet may not be covered 104 with a white-out toner. In an embodiment, a user may make a determination 103 as to whether a sheet is acceptable for reuse. Alternatively, the determination 103 may be made by a processor receiving information from, for example, one or more sensors. Additional and/or alternate factors contributing to determining 103 whether the sheet is acceptable for reuse may also be used within the scope of this disclosure.

At least a portion of the printed image on the sheet may be covered 104 with a white-out toner using a white-out unit. The white-out toner must be sufficiently opaque to cover the previously printed image and may be configured to substantially match the shade and gloss of the sheet. In an embodiment, the white-out unit may be separate from a printing device which may have initially received 101 the sheet. Alternately, the sheet may be covered 104 by the white-out toner using a white-out unit incorporated into a printing device. Additional and/or alternate types of white-out units may also be used within the scope of this disclosure.

The white-out toner may be fused 105 onto the sheet. In an embodiment, the white-out toner may be fused 105 through use of an ordinary heated two roll fuser. Alternately, the white-out toner may be fused 105 through use of a cold pressure fuser without oil. The cold pressure fixing system used may be one known in the art. For example, cold pressure fixing systems may be used employing rollers which are skewed rather than parallel. As another example, a cold pressure fixing system with cold pressure fixing rollers may be used which attempts to obtain more uniform pressure by employing a pair of parallel rollers requiring no springs. Alternatively, a small amount of oil may be used to provide release from the surface of the fuser roll without affecting the subsequent application of white-out toner layers. In an embodiment in which information may be printed on both sides of a sheet, the white-out toner may be fused 105 on both sides of the sheet.

The white-out toner may be a toner or an ink. In an embodiment, the white-out toner may be used in a solid ink-jet printer system. Additional and/or alternate white-out toners may also be used within the scope of this disclosure. For example, UV curable white ink from Sun Chemical or Hexion may be used in a white-out unit.

The new image may be printed 106 onto the sheet. In an embodiment, at least a portion of the new image may be printed 106 on a surface of the white-out toner.

The above receiving, scanning, determining, covering, fusing and printing operations 101-106 may be performed 107 on the sheet a plurality of times. For example, the white-out toner may be configured to enable the above receiving, scanning, determining, covering, fusing and printing operations 101-106 to be performed 107 on the sheet at least six times during a time in which the sheet is acceptable for reuse. The white-out toner image has the surface energy characteristics which allow subsequent toner images to strongly adhere to its surface during heated or cold pressure fusing processes. In an embodiment, UV curable white ink from Sun Chemical or Hexion may be used.

Figure 2:
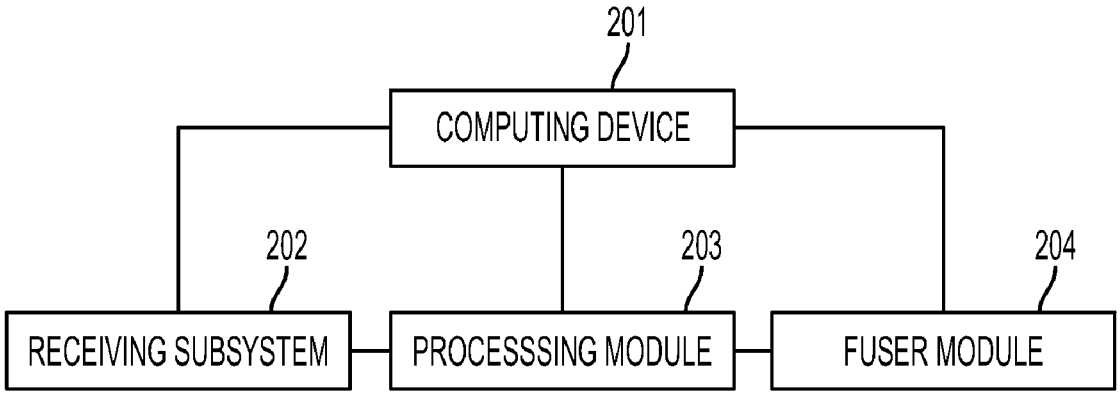
FIG. 2 illustrates an exemplary printing device for covering a printed image according to an embodiment.

FIG. 2 depicts a printing device for covering a printed image according to an embodiment. The printing device may include one or more of a receiving subsystem 202, a processing module 203, and a fuser module 204. Each module may include a software module and/or a hardware module. In addition, each module may be a self-contained component that may interact with the printing device and/or other modules.

The receiving subsystem 202 may be a system within the printing device that is configured to receive one or more sheets. The receiving subsystem 202 may receive a sheet from, for example, a paper tray on which at least one sheet is placed. The receiving subsystem 202 may include one or more nips used to transmit the at least one sheet to the processing module 203. The receiving subsystem 202 may further include one or more motors to drive the one or more nips. Other components may also be present in the receiving subsystem 202. The receiving subsystem 202 may be connected to the processing module 203.

The processing module 203 may be a subsystem in the printing device for processing information regarding the status of at least one sheet and would receive the sheet or sheets from the receiving subsystem in order to process the information. The processing module 203 may include one or more automated sensors to detect the location and orientation of and to sense the status of the sheet or sheets. The processed information may result in rejection of the sheet for further processing if the sensors, for example, sense a tear, wrinkle, or other sheet defect that renders the sheet unacceptable for reuse.

In an embodiment, the processing module 203 may include automated sensors which determine whether a sheet is acceptable for reuse received by the receiving module 202. The processing module 203 may be configured to determine whether the sheet is acceptable for reuse by determining whether the sheet is ripped, substantially wrinkled, and/or stained. If the sheet is determined to be ripped, substantially wrinkled, and/or stained, the sheet may be determined to be unacceptable for reuse and at least one portion of the printed image on the sheet may not be covered with a white-out toner. Additional and/or alternate factors contributing to the determination of whether the sheet is acceptable for reuse may also be used within the scope of this disclosure.

A fuser module 204 may be connected to the processing module 203 and may be a subsystem of the printing device or a separate device for fusing toner onto a sheet. The fuser module 204 may include heated rollers through which at least one sheet is fed. The fuser module 204 may apply heat and pressure to fuse toner onto the at least one sheet. The fuser module 204 may further include a toner unit that includes white-out toner.

The fuser module 204 may be configured to fuse a white-out toner. In an embodiment, the white-out toner may be opaque. The white out toner may be configured to substantially match the shade and gloss of the sheet. The white-out toner may be capable of accepting another toner on its surface.

In an embodiment, the fuser module 204 may be configured to cover at least a portion of a printed image on the sheet with the white-out toner. In an embodiment, the fuser module 204 may be configured to print the scanned image onto the sheet and fuse the image. In an embodiment, the fuser module 204 may be configured to fuse the image using a cold pressure fuser without oil. Alternatively, a small amount of oil may be used to provide release from the surface of the fuser roll without affecting the subsequent application of white-out toner layers.

In an embodiment, the fuser module 204 may be configured to be used for simplex printing. Alternatively, the fuser module 204 may be configured to be used for duplex printing.

It will be appreciated that various of the above-disclosed and other features and functions, or alternatives thereof, may be desirably combined into many other different systems or applications It will also be appreciated that various presently unforeseen or unanticipated alternatives, modifications, variations or improvements therein may be subsequently made by those skilled in the art which are also intended to be encompassed by the disclosed embodiments

What is claimed is:

1. A method of reusing a sheet, comprising:

receiving a sheet having a printed image;

scanning a new image;

determining whether the sheet is one or more of the following: ripped, substantially wrinkled, and stained;

determining the sheet to be unacceptable for reuse if the sheet is one or more of the following: ripped, substantially wrinkled, and stained;

covering at least one portion of the printed image on the sheet with a white-out toner via a white-out unit, unless the sheet is determined to be unacceptable for reuse;

fusing the white-out toner to the at least one portion of the sheet;

printing a new image onto the sheet, unless the sheet is determined to be unacceptable for reuse; and performing the receiving, scanning, determining, covering, fusing and printing operations on the sheet a plurality of times.

2. The method of claim 1, wherein performing the receiving, scanning, determining, covering, fusing and printing operations on the sheet a plurality of times comprises performing the receiving, scanning, determining, covering, fusing and printing operations on the sheet at least six times.

3. The method of claim 1, wherein the white-out toner comprises UV curable white ink.

4. The method of claim 1, wherein fusing the white-out toner comprises fusing the white-out toner using a cold pressure fuser without oil.

5. The method of claim 1, wherein fusing the white-out toner comprises fusing the white-out toner using a cold pressure fuser with oil, wherein the oil provides release from a surface of a fuser roll without affecting a subsequent application of white-out toner.

6. The method of claim 1, wherein printing the new image comprises printing at least a portion of the new image on a surface of the white-out toner.

7. The method of claim 1, wherein fusing the white-out toner comprises fusing the white-out toner on both sides of the sheet.

8. The method of claim 1, wherein covering at least a portion of the printed image comprises covering at least a portion of the printed image via a white-out unit incorporated into a printing device.

9. A printing device for covering and printing over a printed image, comprising:

a receiving subsystem configured to receive a sheet;

a processing module configured to determine whether the sheet is acceptable for reuse; and a fuser module configured to fuse a white-out toner, wherein the processing module is configured to determine whether the sheet is acceptable for reuse by determining whether the sheet is one or more of the following: ripped, substantially wrinkled, and stained, and wherein if the sheet is one or more of the following: ripped, substantially wrinkled, and stained, determining the sheet to be unacceptable for reuse and not covering at least one portion of the printed image on the sheet with a white-out toner.

10. The printing device of claim 9, wherein the fuser module is further configured to cover at least a portion of the printed image on the sheet with the white-out toner.

11. The printing device of claim 9, wherein the fuser module is further configured to print a new image onto the sheet.

12. The printing device of claim 9, wherein the fuser module is further configured to use a cold pressure transfix without oil.

13. The printing device of claim 9, wherein the fuser module is further configured to use a cold pressure transfix with oil, wherein the oil provides release from a surface of a fuser roll without affecting a subsequent application of white-out toner.

14. The printing device of claim 9, wherein the fuser module is further configured to be used for simplex printing.

15. The printing device of claim 9, wherein the fuser module is further configured to be used for duplex printing.

16. A method of reusing a sheet, comprising:

receiving a sheet having a printed image;

scanning a new image;

determining whether the sheet is acceptable for reuse;

covering at least one portion of the printed image on the sheet with a white-out toner via a white-out unit;

fusing the white-out toner to the at least one portion of the sheet;

printing a new image onto the sheet; and performing the receiving, scanning, determining, covering, fusing and printing operations on the sheet at least six times.

17. The method of claim 16, wherein fusing the white-out toner comprises fusing the white-out toner using a cold pressure fuser without oil.

18. The method of claim 16, wherein fusing the white-out toner comprises fusing the white-out toner using a cold pressure fuser with oil, wherein the oil provides release from a surface of a fuser roll without affecting a subsequent application of white-out toner.

19. The method of claim 16, wherein fusing the white-out toner comprises fusing the white-out toner on both sides of the sheet.

20. The method of claim 16, wherein covering at least a portion of the printed image comprises covering at least a portion of the printed image via a white-out unit incorporated into a printing device.

* * * * *